US006164962A

United States Patent [19]

Klobucar

[11] Patent Number: 6,164,962

[45] **Date of Patent: *Dec. 26, 2000**

[54] RAPID COOLING DOWN METHOD FOR REGENERATIVE THERMAL OXIDIZER

[75] Inventor: Joseph M. Klobucar, Detroit, Mich.

[73] Assignee: Durr Environmental, Inc., Plymouth, Mich.

[ * ] Notice: Under 35 U.S.C. 154(b), the term of this patent shall be extended for 49 days.

[21] Appl. No.: 08/854,516

[22] Filed: May 12, 1997

[51] Int. Cl.[7] ..... F27D 17/00

[52] U.S. Cl. ..... 432/179; 432/180; 432/18

[58] Field of Search ..... 432/181, 180, 432/179

[56] References Cited

U.S. PATENT DOCUMENTS

| | | | |
|---|---|---|---|
| 5,026,277 | 6/1991 | York | 432/181 |
| 5,101,741 | 4/1992 | Gross et al. | 432/181 |
| 5,417,927 | 5/1995 | Houston | 432/181 |
| 5,538,420 | 7/1996 | Klobucar et al. | 432/181 |
| 5,540,584 | 7/1996 | Creco | 432/181 |

*Primary Examiner*—Denise L. Ferensic
*Assistant Examiner*—Jiping Lu

[57] ABSTRACT

A method of cooling a regenerative thermal oxidizer down rapidly includes the steps of increasing the cycle time of the heat exchangers once a decision has been made to shut the regenerative thermal oxidizer down. By increasing the cycle time, the regenerative thermal oxidizer rejects more heat from the system. That is, the efficiency of the system goes down, and more heat is lost. In this way, the system approaches an ambient temperature much more quickly then in known systems. In one method of performing this invention, the cycle time is increased as much as possible, and as rapidly as possible while monitoring the outlet temperature on the outlet gas. The cycles are reversed only when the outlet temperature approaches a maximum safe operating temperature. In a second method, the cycle times are increased in pre-programmed steps. By utilizing the present invention, one is able to cool a regenerative thermal oxidizer to ambient temperatures in less than half the time of the prior art systems.

6 Claims, 1 Drawing Sheet

RAPID COOLING DOWN METHOD FOR REGENERATIVE THERMAL OXIDIZER

BACKGROUND OF THE INVENTION

This invention relates to a method of cooling off a regenerative thermal oxidizer for shut down, to allow the regenerative thermal oxidizer to cool off much more quickly than has been the case in the prior art.

Regenerative thermal oxidizers are utilized to remove impurities from an industrial air stream. Thus, an air stream from an industrial process, such as a paint spray booth, is brought to a regenerative thermal oxidizer. Air with impurities to be removed passes in an inlet mode through a previously heated heat exchanger, and into a combustion chamber. The impurities are baked out of the air in the heat exchanger and combustion chamber. The air with the impurities entering the heat exchanger is relatively cool. Once combusted in the combustion chamber the air is hot, and leaves through a second heat exchanger which is in an outlet mode. The heat exchangers switch between the inlet and outlet modes, heating the inlet air, and cooling the outlet air. In some regenerative thermal oxidizers a "purge" mode is utilized to remove entrapped dirty air before switching to outlet mode from inlet mode.

Regenerative thermal oxidizers and the associated heat exchangers can reach very high temperatures. When internal maintenance or inspection of an RTO is required, it is first necessary to cool the combustion chamber and heat exchangers to near ambient temperatures. It is typical that this process will take between 18 and 36 hours if the RTO is cooled by simply turning off the combustion chamber burner.

Obviously, if a routine inspection or immediate maintenance is desired, it would be beneficial to cool the regenerative thermal oxidizer much quicker. In addition, it is inefficient to require a long cool-down time with the regenerative thermal oxidizer being shut down.

SUMMARY OF THE INVENTION

In a disclosed embodiment of this invention, a regenerative thermal oxidizer is cooled much more quickly than in the prior art. In a method according to the present invention, the cycle time between the heat exchangers being in an inlet and outlet mode is increased gradually. By increasing the cycle time, heat removed from the combustion chamber and system is greatly increased. Thus, the system loses heat much more rapidly.

By utilizing this method the present invention is able to cool the regenerative thermal oxidizer to ambient temperatures much more quickly than in the prior art. With the present invention, a regenerative thermal oxidizer can be cooled to ambient in less than eight hours.

In one embodiment of this invention, the increase in the cycle time is taken in pre-programmed incremental steps. In a second embodiment, the cycle time is increased gradually while the temperature of the outlet gas is monitored. The cycle time is continuously increased until the temperature of the outlet gas reaches a temperature which would be unsafe for downstream equipment. At that time, the cycle time is no longer increased. By tying the cycle time to the maximum allowable temperature the present invention is ensuring that the maximum amount of heat is removed from the system as rapidly as possible.

In a method according to this invention, once it has been determined that shut down is desired, one of the two above methods is initiated. Cool dow is thus achieved quite rapidly.

These and other features of the present invention can be best understood from the following specification and drawings, the following of which is a brief description.

DETAILED DESCRIPTION OF A PREFERRED EMBODIMENT

Figure 1:
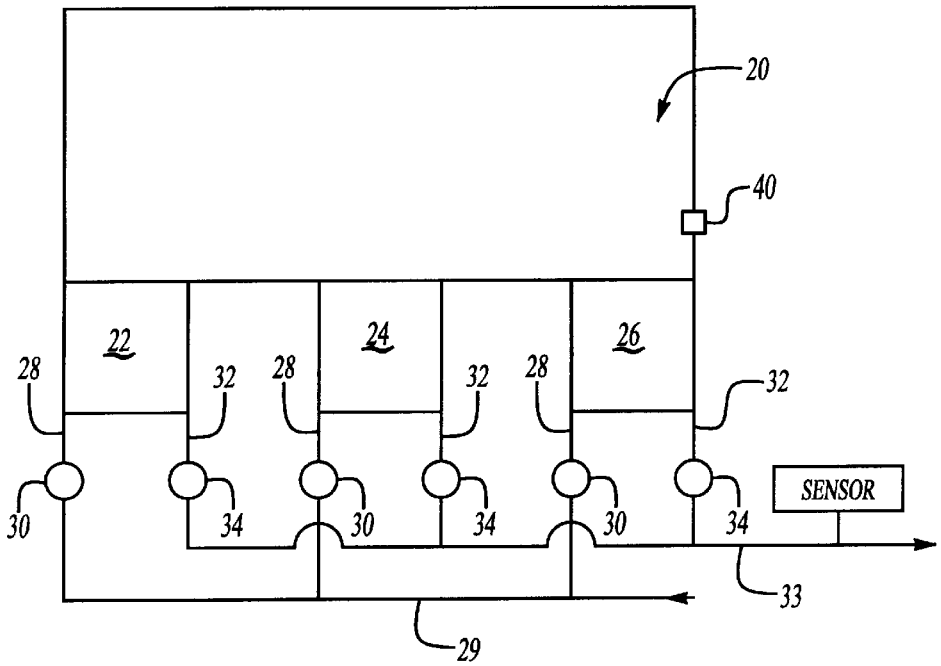
FIG. 1 schematically shows a regenerative thermal oxidizer.

A regenerative thermal oxidizer 20 as known incorporates two or three heat exchangers. Here, three heat exchangers 22, 24 and 26 are shown. An inlet line 28 communicates with each heat exchanger and an inlet manifold 29 to deliver a gas to be cleaned to the regenerative thermal oxidizer 20. The combustion chamber 21 receives gas from the heat exchangers 22, 24 and 26. An inlet valve 30 controls flow through the inlet lines 28 to the respective heat exchangers. An outlet line 32 leads from each heat exchanger to an outlet manifold 33. An outlet valve 34 controls the flow of a fluid through the outlet lines 32 to the outlet manifold 33.

Typically one inlet valve 30 and one outlet valve 34 on different heat exchangers are open. Gas from inlet manifold 29 can move through the heat exchanger having the open inlet valve 30 and into the combustion chamber 21. At the same time, gas from the combustion chamber 21 is moving through another heat exchanger having an open outlet valve 34 into the outlet manifold 33. By cyclically changing the heat exchangers having the open inlet and outlet valves, the heat exchangers are cyclically cooled by the incoming relatively cool gas to be cleaned, and heated by the outgoing gas from the combustion chamber 21. The heat exchanger serves to raise the temperature of the gas going into the combustion chamber, thus increasing the efficiency of the system.

A sensor 36 is placed on the outlet manifold 33 to sense the temperature in the outlet line. Flow components such as fans, dampers, etc. are positioned downstream of the sensor 36, and the sensor 36 is utilized to ensure that the temperature of the outlet gas does not exceed a maximum safe temperature for those downstream components.

The present invention is a method of ensuring that the regenerative thermal oxidizer reaches an ambient temperature to allow maintenance or inspection as rapidly as possible. To that end, when it is desired to shut down the regenerative thermal oxidizer, the regenerative thermal oxidizer enters a cool-down mode.

Figure 2A:
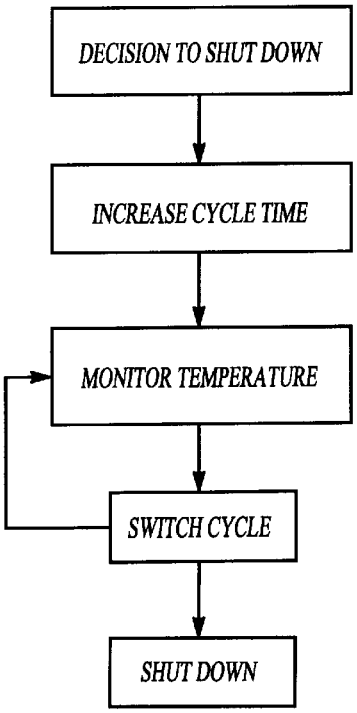
FIG. 2A is a flow chart of one inventive method.

As shown in the flow chart FIG. 2A, once the decision to shut down is made, the cool-down mode begins with increasing the cycle time of the inlet and outlet valves being open on the respective regenerative thermal oxidizer heat exchangers 22, 24 and 26.

In a regenerative thermal oxidizer operation, the outlet temperature is lowest just after the outlet valve on one heat exchanger opens. This is true because the heat exchanger at that point is as cool as it will be throughout the entire cycle. The temperature of the outlet gas climbs as the cycle continues because heat from the combustion chamber is building up in the outlet heat exchanger.

The present invention increases the cycle time causing the outlet temperature to continue to rise above normal operating temperatures. In this way, more heat is removed from the system than is the case in the prior art.

The cycle is reversed after a period of time that is controlled in one of two methods.

In the FIG. 2A method, the cycle is reversed when the outlet temperature reaches a safe operating temperature limit for the downstream equipment. That is, the outlet valve on a particular heat exchanger is maintained open until sensor 36 determines that the temperature is approaching maximum safe operating limit. The cycle is then reversed at that point. Of course, a safety margin on the maximum temperature may be incorporated.

In this way, each cycle causes a maximum amount of heat to be rejected by the regenerative thermal oxidizer, and thus rapidly cools down the system.

Figure 2B:
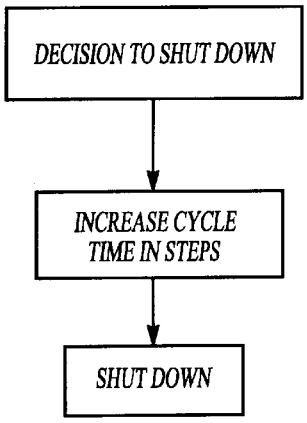
FIG. 2B is a flow chart of a second inventive method.

In a second method shown in FIG. 2B, a pre-programmed series of increases in the damper cycle time is utilized. The cycle time is increased in a series of steps with spacing and size of the steps predetermined and predicted to maintain the outlet temperature below the safe operating limit of the downstream equipment. Such a system can still be utilized with sensor 36 to ensure that the preprogrammed steps do not result in the maximum safe operating temperature being exceeded.

With either method, once the temperature of the system drops below the maximum safe operating temperature, cycling can be stopped. After this temperature is reached, one inlet valve and one outlet valve can be left open and the system will then cool to ambient extremely quickly. It is possible to reach ambient in less than two hours after this point is reached. To this end, a sensor 40 may monitor the temperature of the combustion chamber.

As an example, of the benefits available from the inventive methods in known regenerative thermal oxidizer operation, a cycle time of approximately 120 seconds is typical. In such a system, inlet temperatures of approximately 100° F. and outlet temperatures of around 200° F. are typical.

With the present invention, the RTO cooling cycle time could increase to approximately 600 seconds. Such a longer cycle time would cause the outlet temperature to average 350° F., and could result in peaks of up to 600° F. A regenerative thermal oxidizer operating under such cycle times would dump heat approximately 2.5 times as fast as in a normal operating regenerative thermal oxidizer. As the temperature within the regenerative thermal oxidizer continues to drop, the cycle time could continue to increase, which would continue to accelerate the heat loss. Finally, when the highest temperature in the regenerative thermal oxidizer heat exchangers drops below the maximum safe operating limit for the downstream equipment, valve cycling can cease altogether. All remaining heat can then be removed from the regenerative thermal oxidizer in about two hours. In such a system, the regenerative thermal oxidizer can be cooled to ambient temperatures in a period of under eight hours.

Preferred embodiments of this invention have been disclosed, however, a worker of ordinary skill in the art would recognize that certain modifications would come within the scope of this invention. For that reason, the following claims should be studied to determine the true scope and content of this invention.

What is claimed is:

1. A method of rapidly cooling a regenerative thermal oxidizer comprising the steps of:

(1) providing a combustion chamber, and at least two heat exchangers communicating with said combustion chamber, each of said heat exchangers having an inlet valve and an outlet valve, said inlet valve communicating with a source of gas to be cleaned and said outlet valve communicating with a line leading to a downstream destination for said gas;

(2) opening an inlet valve associated with a first heat exchanger, and opening an outlet valve associated with a second of said heat exchangers, said outlet valve on said first heat exchanger remaining shut, and the said inlet valve on said second heat exchanger remaining shut;

(3) delivering gas to be cleaned through said open inlet valve, combusting said gas in said combustion chamber, and delivering a cleaned gas through said open outlet valve;

(4) cyclically changing said heat exchanger with an open inlet valve to having an open outlet valve on a cycle time, and said heat exchanger with an open outlet valve to having an open inlet valve;

(5) initiating shut down of said regenerative thermal oxidizer, and moving into a cool-down mode; and (6) then increasing said cycle time of said open inlet and outlet valves to rapidly cool said regenerative thermal oxidizer.

2. A method of rapidly cooling a regenerative thermal oxidizer comprising the steps of:

(1) providing a combustion chamber, and at least two heat exchangers communicating with said combustion chamber, each of said heat exchangers having an inlet valve and an outlet valve, said inlet valve communicating with a source of gas to be cleaned and said outlet valve communicating with a line leading to a downstream destination for said gas;

(2) opening an inlet valve associated with a first heat exchanger, and opening an outlet valve associated with a second of said heat exchangers, said outlet valve on said first heat exchanger remaining shut, and the said inlet valve on said second heat exchanger remaining shut;

(3) delivering gas to be cleaned through said open inlet valve, combusting said gas in said combustion chamber, and delivering a cleaned gas through said open outlet valve;

(4) cyclically changing said heat exchanger with an open inlet valve to having an open outlet valve on a cycle time, and said heat exchanger with an open outlet valve to having an open inlet valve;

(5) initiating shut down said regenerative thermal oxidizer, and moving into a cool-down mode;

(6) then increasing said cycle time of said open inlet and outlet valves to rapidly cool said regenerative thermal oxidizer; and increasing said cycle time for as long as possible, with a sensor monitoring the temperature on said outlet line and determining when said cycle should be switched, said sensor comparing said temperature in said outlet line to a predetermined maximum temperature, and switching said cycle when said outlet line reaches said predetermined maximum temperature.

3. A method as recited in claim 2, wherein said predetermined maximum temperature is selected to approximate a safe operating temperature for equipment mounted downstream from said outlet line.

4. A method as recited in claim 3, including the step of monitoring the temperature of the combustion chamber, and once said chamber falls below a predetermined temperature, stopping cycling under steps (4) and (6) but continuing steps (2) and (3).

5. A method as recited in claim 1, including the step of monitoring the temperature of the combustion chamber, and once said chamber alls below a predetermined temperature, stopping cycling under steps (4) and (6) but continuing steps (2) and (3).

6. A method as recited in claim 1, including the step of increasing said cycle times in a series of increasing pre-programmed steps.

* * * * *